US005746666A

United States Patent [19]

Lovett

[11] Patent Number: 5,746,666

[45] Date of Patent: May 5, 1998

[54] GOLF CLUB AND CLUB HEAD

[75] Inventor: William E. Lovett, Naples, Fla.

[73] Assignee: Love It Golf Company, Naples, Fla.

[21] Appl. No.: 744,786

[22] Filed: Nov. 6, 1996

[51] Int. Cl.[6] ..... A63B 53/04

[52] U.S. Cl. ..... 473/328; 473/345

[58] Field of Search ..... 473/324, 328, 473/345, 327, 349, 350

[56] References Cited

U.S. PATENT DOCUMENTS

| | | | |
|---|---|---|---|
| 1,396,470 | 11/1921 | Taylor . | |
| 1,587,758 | 6/1926 | Charavay . | |
| 1,617,090 | 2/1927 | Worthington | 473/328 |
| 1,695,598 | 12/1928 | MacClain | 473/328 |
| 1,975,822 | 10/1934 | Young | 473/328 |
| 3,862,759 | 1/1975 | Evans et al. | 473/328 |
| 3,985,363 | 10/1976 | Jepson et al. . | |
| 4,139,196 | 2/1979 | Riley . | |
| 4,313,607 | 2/1982 | Thompson | 473/328 |
| 5,271,620 | 12/1993 | Moriguchi et al. | 473/349 X |
| 5,288,079 | 2/1994 | Katayama | 473/328 |
| 5,301,945 | 4/1994 | Schmidt et al. | 473/328 X |
| 5,451,056 | 9/1995 | Manning | 473/328 |
| 5,470,068 | 11/1995 | Schmidt et al. . | |
| 5,470,069 | 11/1995 | Schmidt et al. . | |
| 5,484,155 | 1/1996 | Yamawaki et al. . | |
| 5,611,741 | 3/1997 | Schmidt et al. | 473/328 |

FOREIGN PATENT DOCUMENTS

| | | | |
|---|---|---|---|
| 219804 | 8/1924 | United Kingdom | 273/167 E |

*Primary Examiner*—Raleigh W. Chiu
*Attorney, Agent, or Firm*—Oldham & Oldham Co., LPA

[57] ABSTRACT

A golf club with a club head having a front ball striking face, and top and bottom walls. The striking face has a configuration which gradually narrows downwardly to form a relatively blunt lower apex on the perimeter of the face. The bottom wall surface extends rearwardly and upwardly from the lower edge of the striking face toward the top wall surface. The striking face configuration and the bottom wall surface configuration substantially reduces turf contact and drag resistance on both the back and forward swings. The striking surface has a pitch angle with loft to lift and fly the golf ball over intervening turf onto a golf green.

15 Claims, 4 Drawing Sheets

10
12
36
26
24
14
22
48
30
28
50

12
36
20
26
16
18
28
24
14
22

GOLF CLUB AND CLUB HEAD

BACKGROUND OF THE INVENTION

1. Field of the Invention

This invention relates generally to golf clubs and, in particular, to multi-purpose golf clubs, e.g. clubs that can be used both for chipping a golf ball onto a golf green and distance shots.

2. Prior Art

In the past, golfers have searched for the best method of getting a ball onto a golf green from a relatively close range. Many have settled on using wedges, lofted irons such as nine, eight or seven irons, or irons having even less loft, depending upon the lie of the ball. More recently, both professionals and amateurs are trying fairway woods to chip or roll a golf ball onto a green.

The difficulty with all of the above-noted methods, is that there is a substantial drag resistance on both the forward and back swings, of the clubs discussed just above, when the golf ball is in a bad lie in "turf". As used herein the word "turf" shall be understood to mean grass that is somewhat longer than the very short grass on the green (which provides a very smooth putting surface). For example, this includes grass on the "collar", "frog hair", or "fringe" around the green, and also longer grass which is substantially longer and is normally designated "rough". The word "turf" shall further mean weeds, sand, mud, and other material engageable and displaceable by the bottom wall and the ball striking surface of the club.

Thus, there is a need to reduce this drag resistance and the drag forces which prevent golfers from executing the best swing at and the most accurate contact with a golf ball. Obviously, any interference with the travel of a golf club on either the back or forward swing will push, pull, twist or slow the club head out of sync with a desired swing path or velocity and result in an inaccurate shot.

In U.S. Pat. No. 5,470,068 ("068"), issued Nov. 28, 1995, there is a discussion of such "turf" interference with the swing of a putter. A golf putter head is disclosed which has a front wall striking surface, and top and bottom walls. The bottom wall has a central medial ridge and two dished shallow recesses, one recess between the ridge and the heel portion, and the other recess between the ridge and the toe portion. Both recesses are spaced rearwardly from the front wall.

The medial ridge on the bottom wall of the club head is horizontal, so that it is tangential to the ground. Since the curvature of the earth with respect to the bottom of the club head is negligible, the medial ridge is essentially in contact with the ground or "turf" throughout its length from the front to rear of the club head. Further, the ridge diverges, or broadens, as it approaches the front striking face so that there is more contact with the "turf" or ground. Similarly, the medial ridge diverges at its opposite end also creating more drag resistance. Thus, the ridge and the divergences thereof would create substantial drag resistance on both the back and forward swings of the club head.

To try to overcome this drag resistance, the bottom of the "068" club head has two recesses formed therein, one on each side of the ridge. These recesses allow the ridge to penetrate the turf, resisting and repelling the turf against the recesses to limit penetration. According to the specification, the turf engages the inclined surfaces of the recesses creating a lift force acting to urge the bottom wall and the head in an upward direction. This urging upwardly or lifting up of the club head obviously interferes with travel along a desired swing path, causing an inaccurate shot.

While the "068" putter head might be helpful in some instances, the fact remains that the medial ridge and the laterally extending lower edge of the striking front face still engage the "turf", creating inaccuracies in the golf swing and in the contact of the striking face with the golf ball.

Moreover, the striking face of the "068" is angled only a nominal amount with respect to the vertical with a pitch that is determined by the amount of loft desired. The loft of a putter head is nominal, because the object of striking a ball with a putter is to start it moving and rolling (not bouncing) smoothly along a desired path on the very short grass on a golf green. On the other hand, such a nominal pitch with not lift a golf ball from "turf" for more than a very, very short distance from a golf green with any degree of accuracy, because the nominal loft of a putter cannot lift and "fly" the ball up and over intervening "turf" onto a green.

In U.S. Pat. No. 5,470,069 ("069"), issued Nov. 28, 1995, to the same inventors listed in the "068" patent, a "wood" club is disclosed. The "069" patent also discusses "turf" interference with the swing of the club head, and uses a sole plate or bottom wall configuration that is essentially the same as that shown in the "068" patent for a putter to reduce turf interference. Thus, difficulties solved by the improved club of the present invention are not resolved by the "069" patent, since the urging upwardly of the club head by the recesses and the medial ridge also interferes with travel along a desired swing path causing inaccurate shots.

U.S. Pat. No. 1,396,470, issued Nov. 8, 1921, discloses a club head having what appears to be a substantially planar striking surface 17 (with an inlaid plate 18). However, there is no discussion of drag resistance problems. The horizontally extending bottom edge of the striking surface causes considerable drag resistance. Further, the sole or bottom wall surface extends backwardly from the striking surface with at least seventy-five percent in contact with the ground, further increasing drag resistance.

U.S. Pat. No. 1,587,758, issued Jun. 8, 1926, similarly shows a golf club head with a horizontally extending bottom edge, and a sole plate that touches the ground for more than sixty percent of its length, both of which cause considerable drag resistance.

U.S. Pat. No. 3,985,363, issued Oct. 12, 1976, discloses a wood type golf club. However, once again, there is a substantial horizontal extension of the bottom edge and a flat sole plate, that cause considerable drag resistance.

U.S. Pat. No. 4,139,196, issued Feb. 13, 1979, discloses a wood type golf club. Again, there is a substantial flat sole plate and horizontally extending bottom edge of the striking face, causing considerable drag resistance.

U.S. Pat. No. 5,484,155, issued Jan. 16, 1996, also discloses a wood type golf club, which again has a large flat sole plate and a substantial lateral extension of the bottom edge of the striking face, which cause considerable drag resistance.

The above review of the prior art reveals the need for new and improved golf clubs and golf club heads that provide improved golf shots. Accordingly, it is an object of this invention to provide such improved golf clubs.

It is a further object of this invention to provide an improved golf club head which substantially reduces drag resistance to improve shot accuracy.

A still further object of this invention is to provide a multi-purpose golf club and head which is suitable for uses ranging from chipping onto a golf green to hitting full distance shots.

Other objects, advantages and features of this invention will become apparent when the following description is taken in conjunction with the accompanying drawings.

SUMMARY OF THE INVENTION

In contrast to the prior art, the multi-purpose golf club head of the present invention has a pitch which provides loft to a golf ball to land it directly on a green, whether the ball is struck from a yard away, seventy five yards away, one hundred seventy yards away, or the like.

Moreover, the striking surface of the multi-purpose golf club head gradually narrows downwardly to form a relatively blunt lower apex on the perimeter of the striking surface. This substantially reduces turf drag on the lower edge of the striking surface enabling more accurate swing contact with a golf ball, and thus a more accurate shot. In contrast, the putter head of the "068" patent has a striking surface that extends clear across the width of the club head, creating substantial drag resistance on both the forward and backward swings of the putter head through "turf".

In addition, the multi-purpose club head of the present invention has a bottom wall surface that extends rearwardly and upwardly from the lower edge of the striking face, toward the top surface of the club head. Since the bottom wall surface is extending upwardly away from the turf, this substantially reduces turf contact with the bottom wall, and thus substantially reduces "turf" drag on the bottom wall surface during both the back and forward swings of the club head.

Further, the upwardly extending bottom surface acts as an inverted inclined plane. For a smooth plane inclined at an angle to the horizontal less force is required to move a mass up the plane, thereby putting it in the class of simple machines which includes the lever, the pulley and the screw, all of which are devices for overcoming resistance at one point by the application of a force at some other point. Thus, initiating and moving the club head of the present invention through a back swing requires less effort. This is a combination of the reduced "turf" contact (because of the backwardly and upwardly extending bottom surface wall as discussed above), and because of the reduced resistance effect of the inverted inclined plane effect also discussed above.

As will be described hereinafter and as shown in the drawings, the club head of the present invention will touch the "turf" or the ground, when the golfer is addressing the golf ball prior to a swing, only on the lower edge of the perimeter of the club face at the relatively blunt lower apex on the perimeter. This configuration obviously reduces "turf" contact during both the back and forward swing. In fact, if the club is swung hard enough to take a divot, only a small crescent-shaped divot is taken, fully illustrating the reduced "turf" drag provided by the improved club head of this invention.

BRIEF DESCRIPTION OF THE DRAWINGS

In the drawings, where like numerals are employed to designate like parts throughout.

DESCRIPTION OF THE PREFERRED EMBODIMENTS

Figure 2:
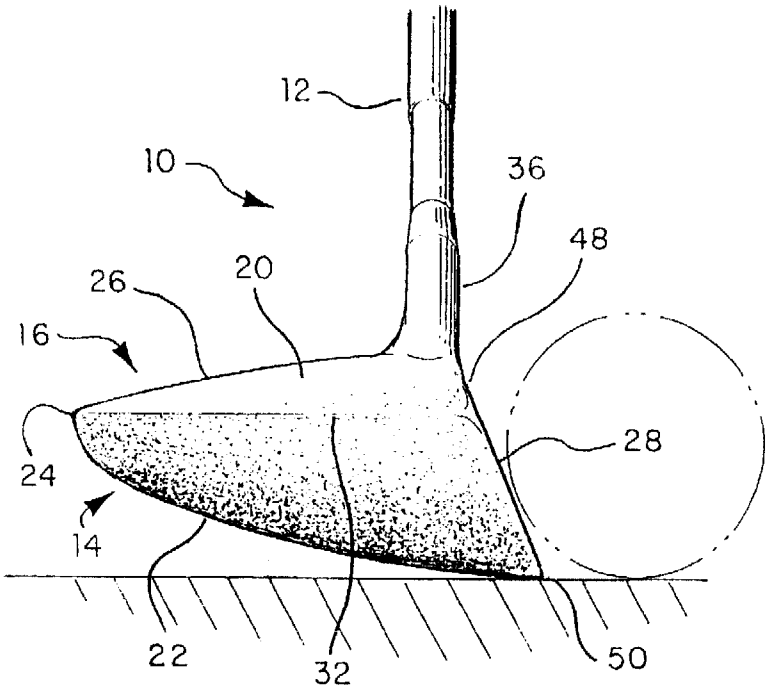
FIG. 2 is an elevational view from the toe side of a golf club head embodying the teachings of this invention.
Figures 3, 4:
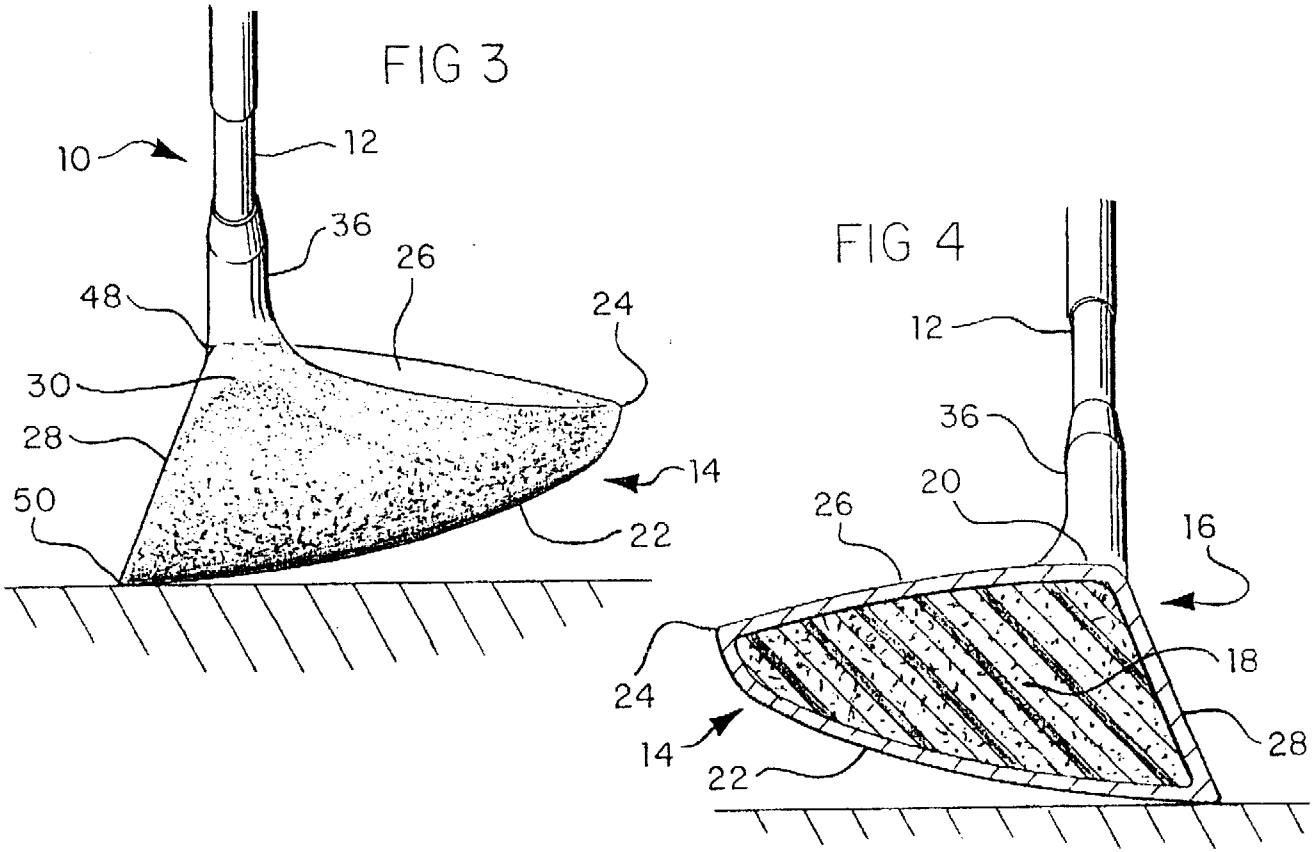
FIG. 3 is a heel elevational view of the head in FIG. 2.
FIG. 4 is a cross-sectional view of the head illustrated in FIG. 2.
Figure 5:
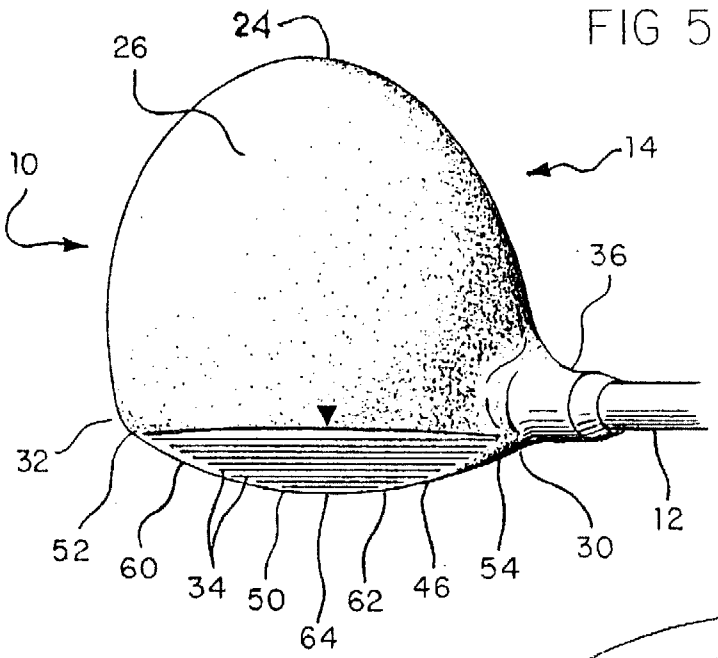
FIG. 5 is a top plan view of the head illustrated in FIG. 2.
Figure 6:
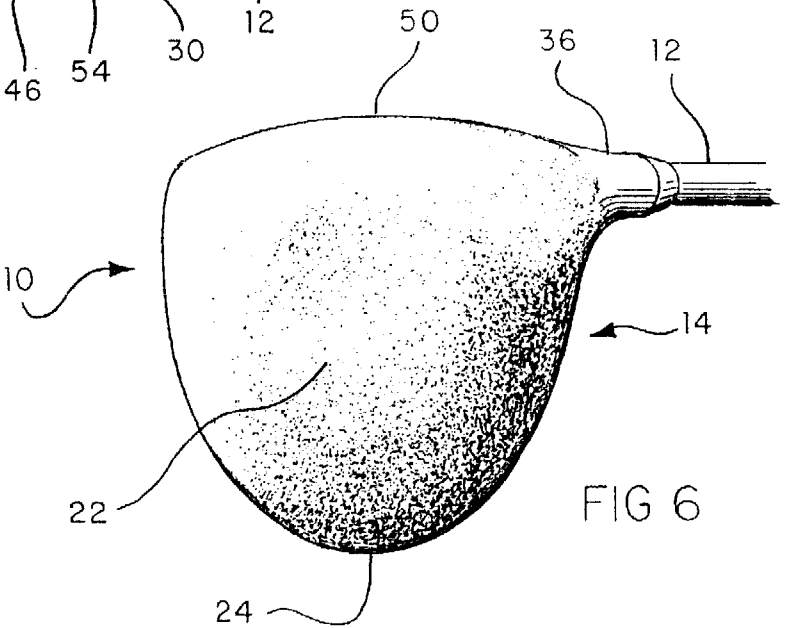
FIG. 6 is a bottom view of the head illustrated in FIG. 2.
Figure 7:
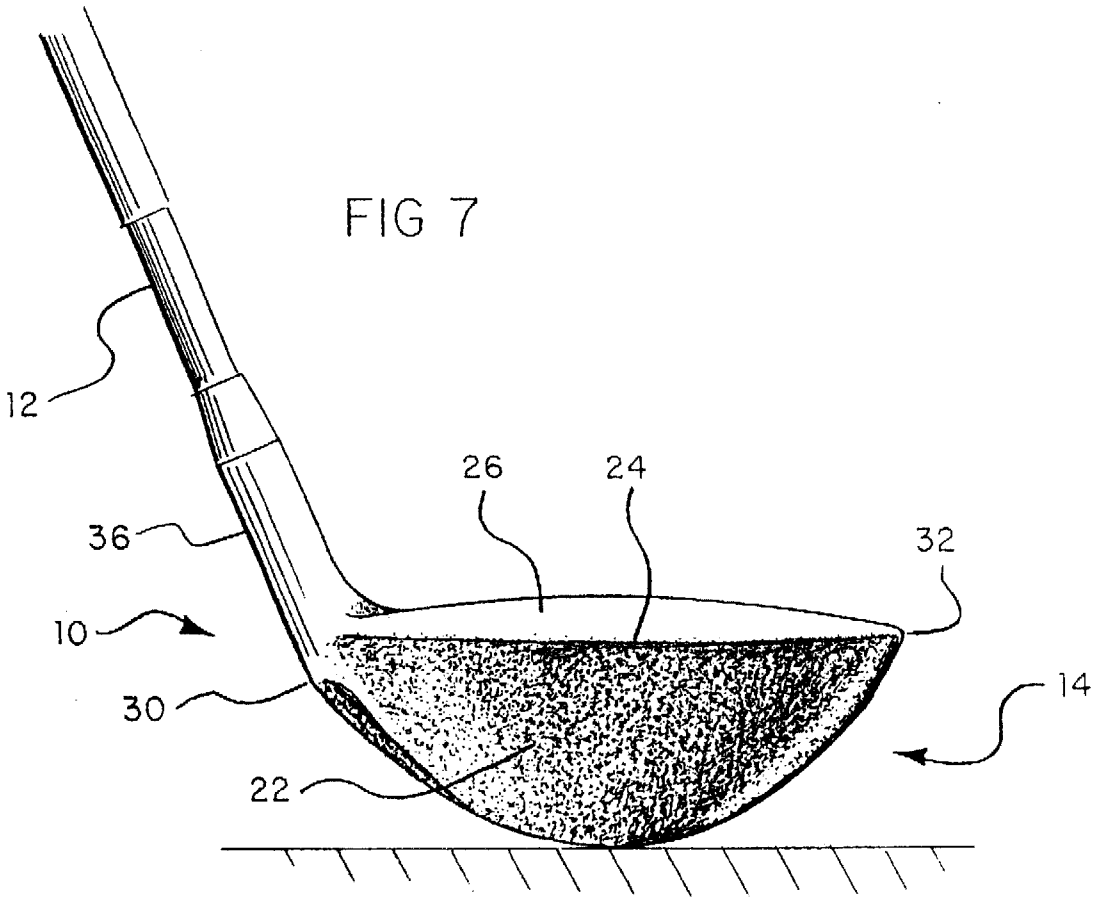
FIG. 7 is a rear elevational view of the head in FIG. 2.

Referring now to the drawings, a multi-purpose golf club is designated generally at 10, in accordance with a preferred embodiment of the present invention. The club 10 includes a shaft 12 (which is broken as shown to reduce the size of the figure), which is attached to a golf club head designated generally at 14. The head 14 is in the general shape of a "wood" club although it is metal in this embodiment. While the use of metal has some advantages, the invention described herein is intended to cover heads made from wood, reinforced resins, and other materials. The head 14 in FIG. 2 comprises a hollow metal shell 16, which is filled with a plastic foam filling 18, e.g. polyurethane. (See FIG. 4). It should be noted that in the preferred embodiment, the wall thickness of the metal shell 16 is more than that of a standard metal wood. It has been found that this additional weight (about thirty to forty percent more than average fairway woods) adds stability to the golf swing and more mass to help slide the club head through turf during a swing.

The shell 16 may be fabricated by the "lost wax" casting method that is well-known in the art. The shell may be formed in two pieces: a main portion 20 and a bottom wall portion (surface) 22 that is peripherally welded to the main portion 20.

The main portion 20 has a top wall surface 26, and a ball-striking surface 28. The striking surface is angled with respect to the vertical with a specified "pitch" that is determined by the type of club and the amount of loft desired, as well as by the golfer who can select the amount of loft from a number of clubs which use the inventive concepts disclosed herein. That is, while there will be described herein an embodiment which can most effectively be used as a multi-purpose club, suitable for chipping or distance shots, the principles set forth can and will be used for a full set of wood type clubs and irons with varying amounts of loft for different types of shots and distances. The pitch angle of the preferred embodiment is twenty three degrees. However, this may be varied between twenty and thirty degrees for the multi-purpose club for chipping and distance shots.

The end portion of the head 14 proximate the shaft 12 is commonly termed the "heel" 30, while the end portion opposite the heel 30 is termed the "toe" 32. In most wood type clubs, the striking surface 28 is typically curved from the heel 30 to the toe 32 in a convex fashion, presumably to correct "hooks" and "slices". However, in the present invention it has been found that if the striking surface were made substantially planar or flat from heel to toe, that more accurate shots could be hit when used in combination with the other unique features of this invention. The improved accuracy or straight shots occurred both when chip shots and distance shots were hit. There was no need to worry about having to strike the ball on the exact apex of the convex face, rather than on one of the curved sides of the face that would steer the ball away from the target.

Figure 1:
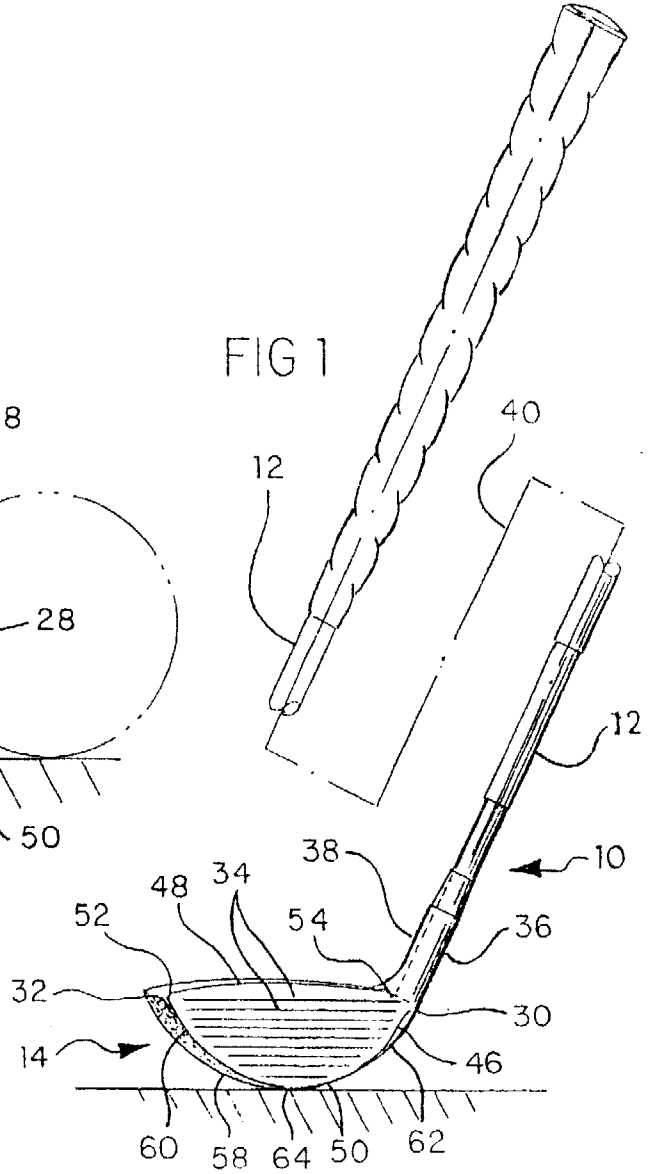
FIG. 1 is a front elevational view of a multi-purpose golf club, with a portion of the shaft broken out to shorten the figure, which embodies the teachings of this invention.

A hosel 36 is integrally formed with the club head 14 to receive one end of shaft 12 in a tubular shaft receiving socket 38 formed in the hosel 36 (see FIG. 1). The hosel socket 38 is dimensioned to receive the lower end of the shaft 12 with a snug fit. The shaft is secured in the socket in a conventional manner, e.g. by a suitable epoxy adhesive with "glue locks" for better adhesive bonding.

One of the difficulties in chipping or hitting full shots with an iron (and sometimes with a "wood") is that shanks occur when the golf ball is struck by both the striking face and the hosel. In the present invention the hosel has been spaced from the striking face so that a golf ball cannot touch the hosel and therefore a shank cannot be hit. (See FIG. 2 where a golf ball is shown in phantom lines.)

The hosel 36 and therefore the lower end of shaft 12 have coincident axes 40 (FIG. 1). Thus, the hosel 36 receives and retains the shaft 12 at a desired angle with respect to the vertical. In the embodiment shown in the drawings the shaft angle with respect to the vertical is 26 degrees, or 64 degrees with respect to the ground. The principle involved is to provide a more upright shaft for better control of the swing arc of the club head. Thus, when chipping close to the green a golfer can use a putting stroke because the shaft is more upright. However, as it was discovered, the more upright shaft is equally useful with full swing and full distance shots, particularly in combination with the substantially planar striking-surface.

It should be kept in mind that the physical characteristics of the golfer may suggest that any of the preferred embodiment statistics may be modified to fit the individual golfer. Those physical characteristics include the golfer's height, arm lengths, etc. Even so, it is believed that a range of twenty to thirty degrees with respect to the vertical covers the shaft angles required by most golfers.

The club head 14 is generally defined by the top wall surface 26 extending rearwardly from an upper edge 48 of the striking surface 28, and a bottom wall surface 22 extending rearwardly from a bottom or lower edge 50, the top and bottom wall surfaces 48, 50 meet at 24 behind the striking surface 28.

The striking surface 28 is defined by a perimeter 46 which includes the upper and lower edges 48, 50 which have intersections 52 on the left side of surface 28 and 54 on the right side of surface 28. The intersections 52, 54 are laterally spaced from each other on opposite sides of the striking surface 28.

The lower edge 50 has a configuration 58 which gradually narrows downwardly below intersections 52, 54 along lines 60, 62 to form a relatively blunt lower apex 64 on the lowest part of the perimeter 46. This configuration does away with the relatively horizontal lower edge that extends laterally across the bottom edge of a standard club head, which has a much larger and longer lower edge which gets caught in turf on both the back and forward swing of the club head. This obviously causes a substantial drag resistance forces with the turf which prevent golfers from executing the best swing at and the most accurate swing contact with a golf ball. Further, if the "turf" is uneven and hits only one side of a lower edge, the club head will twist and cause an inaccurate shot. Any interference with the travel of a golf club head on either the back or forward swing will push, pull, twist or slow the club head out of sync with a desired swing path or velocity and will result in an inaccurate shot.

The configuration 58 narrows gradually so that there is very little lower edge available, other than the relatively blunt lower apex 64, to cause drag resistance, when compared to the standard club head's longer, substantially horizontal or flat, laterally extending lower edge.

The configuration 58 may be provided in a number of different ways. For example, ellipses, parabolas, and hyperbolas are curves which are collectively known as conic sections, as they can be conceived as the curves of intersection between the external surface of a cone and a plane set at various angles to the axis of the cone. A circle is a special case of a conic section, when the intersection of a plane with the axis is perpendicular to the axis of a right circular cone. An arc segment of a circle could define a relatively blunt apex. Thus, the lower edge of a striking surface of a preferred embodiment of a club head in this invention defines a curve which may be a conic section segment to accomplish the unique functions of the club head.

Certain other striking surface shapes or configurations also may accomplish at least part of the unique functions, but may not be as desirable as a conic section curve segment which may be more adaptable for streamlining and reduction of air resistance during a golf swing.

For example, a catenary curve segment could be used to provide the relatively blunt lower apex on the perimeter. This is not unexpected, because certain catenary curves are substantially similar to or the same as a parabola.

In addition, the configuration could be substantially similar to a trapezoid having one pair of substantially parallel opposite sides, with one of the parallel sides being shorter than the other to provide a relatively blunt lower apex on the lower edge of the perimeter. An inverted isosceles trapezoid would probably serve best. Also, the configuration could be substantially similar to a triangle in which an apex pointing downwardly has been truncated to provide a relatively blunt lower apex. As noted above, an inverted isosceles triangle with a truncated apex would probably serve best. It should be noted that in both cases, the trapezoid and triangle would probably serve best if corners were rounded off to reduce air resistance.

The configurations described above also do an excellent job of taking weight and mass from the old club head faces with laterally extending lower edges, and moving that weight up to, behind and surrounding the point on the club face where the ball is struck to provide more effective mass distribution to give more accurate and longer shots. This also provides a larger "sweet spot" on the club face.

This weight and mass redistribution is also helped by the form of the bottom wall surface 22, which extends rearwardly and upwardly from the lower edge 50 of the striking surface toward the top wall surface 26. Further, the location of the meeting 24 of the top wall surface 26 and the bottom wall surface 22 behind the striking surface in a location which is centered with respect to where the ball is struck on the face 28 further assists in obtaining the most beneficial weight and mass distribution.

The rearwardly and upwardly extending bottom wall surface 22 also functions to reduce drag resistance of the back and forward swings. As discussed hereinbefore, the bottom wall surface 22 functions as an inverted inclined plane to require less force to initiate a back swing and keep that swing moving through turf. The backward and upwardly extending bottom wall surface 22 avoids contact with turf and deflects turf to substantially reduce drag resistance during the back swing.

Further, the bottom wall surface 22 also extends arcuately and upwardly in both lateral directions with respect to a vertical center line on the striking surface to further reduce drag resistance and to streamline the club head to reduce air resistance. This also further avoids turf contact and diverts turf away from the bottom wall surface.

Finally, when a golfer uses a golf club according to the present invention to address a golf ball just prior to a golf swing, only the intersection of the lower relatively blunt apex on the striking surface and the bottom wall touches the ground, and the remainder of the bottom wall surface and the lower edge of the perimeter do not touch. This substantially reduces turf contact and reduces drag resistance. In fact if the club is swung hard enough to take a divot, only a small crescent-shaped divot is taken, fully illustrating the reduced "turf" drag provided by the improved club head of this invention.

Grooves 34 may be formed on the striking surface with spaces between, depth, width, and cross-sectional configuration as stated in the rules defining legal clubs. Since the club head is preferably metal the grooves may be formed and retain their dimension for a long, long time. The grooves 34 impart spin to a golf ball to keep it on a desired flight path, and control the stopping distance or back-up when the ball lands on the green.

While the choice of the specific components and their arrangement in the preferred embodiments described herein illustrate the results and advantages over the prior art, the invention is not limited to those specific components and their arrangement. Thus, the forms of the invention shown herein and described are to be taken as illustrative only, and changes in the components or their arrangement may be made without departing from the spirit and scope of this invention. There has been disclosed apparatus which differs from, provides function not performed by, and has clear advantages over the prior art.

I claim:

1. A metal wood type golf club comprising:

a substantially hollow metallic body defining a toe portion, a heel portion, said heel portion having a hosel formed therein and adapted to receive an end of a golf club shaft, a front ball striking surface having a perimeter which includes upper and lower edges, a top wall surface extending rearwardly from said upper edge of said striking surface, and a bottom wall surface extending from said lower edge of said front ball striking surface rearwardly to meet said top wall surface; said bottom wall surface being substantially rounded in the heel to toe direction so as to define a generally blunt apex at the lower edge of said ball striking surface;

said bottom wall surface also being inclined in a rearward direction from a center point on said lower edge of said ball striking surface and said front ball striking surface inclined to define a predetermined loft angle with respect to the ground when the longitudinal axis of said hosel is in a vertical plane parallel to the longitudinal axis of said front ball striking surface.

2. A golf club head as defined in claim 1 in which said configuration of said lower edge of said perimeter of said striking surface is a segment of a conic section curve.

3. A golf club head as defined in claim 2 in which said configuration is a segment of an inverted parabola with an apex on said lower edge of said perimeter.

4. A golf club head as defined in claim 2 in which said configuration is a segment of an ellipse with an apex on said lower edge of said perimeter.

5. A golf club head as defined in claim 2 in which said configuration is a segment of a hyperbola with an apex on said lower edge of said perimeter.

6. A golf club head as defined in claim 2 in which said configuration is a segment of a circle with an arc defining an apex on said lower edge of said perimeter.

7. A golf club head as defined in claim 1 in which said configuration of said lower edge of said perimeter of said striking surface is substantially similar to a triangle in which an apex which was pointed downwardly has been truncated to provide said relatively blunt lower apex on said lower edge of said perimeter.

8. A golf club head as defined in claim 1 in which said configuration of said lower edge of said perimeter is substantially similar to a trapezoid having one pair of parallel opposite sides, one of said parallel sides being shorter than the other of said parallel sides to provide said relatively blunt lower apex on said lower edge of said perimeter.

9. A golf club head as defined in claim 8 in which said configuration is substantially similar to an inverted isosceles trapezoid.

10. A golf club head as defined in claim 1 in which said striking surface is substantially planar.

11. A golf club head as defined in claim 1 in which said meeting of said top and bottom wall surfaces is behind said striking surface and located to center the mass of said club head behind a ball being struck.

12. A golf club head as defined in claim 1 in which said lower edge of said perimeter of said striking face defines an arcuate curve.

13. A golf club head as defined in claim 1 in which said bottom wall surface extends arcuately and upward from said lower edge of said striking surface, so that when said club head is grounded when a golfer addresses the ball only the intersection of said striking surface and said bottom wall surface touches the ground, and the remainder of said bottom wall surface does not touch the ground, thereby substantially reducing turf contact.

14. A golf club as defined in claim 1 in which said configuration of said lower edge of said perimeter is a segment of a conic section curve with an apex on said lower edge of said perimeter.

15. A golf club as defined in claim 1 in which when a golfer is addressing a golf ball just prior to a golf swing, only the intersection of the lower apex of said ball striking surface and said bottom wall surface touch the ground, and the remainder of said bottom wall surface does not touch thereby substantially reducing turf contact.

* * * * *